US009224377B2

(12) United States Patent
Lee et al.

(10) Patent No.: US 9,224,377 B2
(45) Date of Patent: Dec. 29, 2015

(54) COMPUTERIZED PERCUSSION INSTRUMENT

(71) Applicants: Richard Jason Lee, Dublin (IE); Yann Pierre Morvan, Salisbury (GB)

(72) Inventors: Richard Jason Lee, Dublin (IE); Yann Pierre Morvan, Salisbury (GB)

(73) Assignee: FICTITIOUS CAPITAL LIMITED, Edgware, Middlesex (GB)

( * ) Notice: Subject to any disclaimer, the term of this patent is extended or adjusted under 35 U.S.C. 154(b) by 0 days.

(21) Appl. No.: 13/672,797

(22) Filed: Nov. 9, 2012

(65) Prior Publication Data

US 2013/0118339 A1 May 16, 2013

(30) Foreign Application Priority Data

Nov. 11, 2011 (GB) ..... 1119447.9

(51) Int. Cl.

| | |
|---|---|
| ***G10H 1/40*** | (2006.01) |
| ***G10H 1/06*** | (2006.01) |
| ***G10H 1/32*** | (2006.01) |
| ***G10H 7/00*** | (2006.01) |
| ***G10H 1/14*** | (2006.01) |

(52) U.S. Cl.

CPC . *G10H 1/32* (2013.01); *G10H 1/14* (2013.01); *G10H 7/00* (2013.01); *G10H 2220/185* (2013.01); *G10H 2220/201* (2013.01); *G10H 2220/455* (2013.01); *G10H 2230/281* (2013.01)

(58) Field of Classification Search

USPC ..... 84/723

See application file for complete search history.

(56) References Cited

U.S. PATENT DOCUMENTS

| | | | | |
|---|---|---|---|---|
| 4,968,877 | A | 11/1990 | McAvinney et al. | |
| 4,984,001 | A * | 1/1991 | Himuro | 396/88 |
| 2008/0122786 | A1 * | 5/2008 | Pryor et al. | 345/156 |

(Continued)

FOREIGN PATENT DOCUMENTS

| | | | |
|---|---|---|---|
| GB | 2482729 | A | 2/2012 |
| JP | 2004177686 | A | 6/2004 |

(Continued)

OTHER PUBLICATIONS

Christophe Havel and Myriam Desainte-Catherine, Modeling an Air Percussion for Composition and Performance, Proceedings of the 2004 Conference on New Interfaces for Musical Expression, pp. 31 to 34, 2004, National University of Singapore, Singapore, Singapore.

*Primary Examiner* — Christopher Uhlir

(74) *Attorney, Agent, or Firm* — Norton Rose Fulbright US LLP

(57) ABSTRACT

A computerized musical percussion instrument is disclosed. Markers carried by the musician are observed by an imager to produce a series of two dimensional images over the time of the performance.

A processor receives the images and distinguishes between markers (e.g. left hand, right hand) by comparing the position and size of unidentified markers in the current image to the position and size of identified markers in preceding images. The processor analyzes each markers' movements and detects a drum hit when a marker undergoes a sharp reversal of its motion direction after reaching sufficient speed. The processor determines which drum the musician intends to hit by comparing the position and size of the marker at the instant of the hit to the position and size attributes of each drum. The processor outputs an audio signal for each hit, corresponding to the drum hit, with a volume determined by marker speed.

20 Claims, 6 Drawing Sheets

(56) References Cited

U.S. PATENT DOCUMENTS

| | | | | |
|---|---|---|---|---|
| 2008/0223196 | A1* | 9/2008 | Nakamura et al. | 84/600 |
| 2011/0102568 | A1* | 5/2011 | Bonnet | 348/77 |

FOREIGN PATENT DOCUMENTS

| | | | |
|---|---|---|---|
| JP | 2007121355 | A | 5/2007 |
| WO | 2009/007512 | A1 | 1/2009 |

* cited by examiner

COMPUTERIZED PERCUSSION INSTRUMENT

The present disclosure relates to a computer implemented musical instrument, and more particularly to a computer implemented percussion instrument, and still more particularly to a computer implemented percussion instrument utilising motion capture and analysis to mitigate the need for physical surfaces to drum on.

Existing percussion instruments can be divided into four classes.

1) Traditional percussion instruments where the sound is produced by the physical shocks between the drummer's hand or the implement held by the drummer, and the drumming surfaces.

2) Electronic devices consisting of a set of electronic pads configured in such a way as to mimic the layout of their non-electronic counterpart (see 1 above). The electronic pads register the drummer's hits and sounds are synthesised or played back in accordance.

3) Electronic devices arranged in a more practical form factor, such as a roll-up mat, or detached flexible pads, or a set of pads arranged on a board.

4) Software taking advantage of touch screen devices to let the user drum by tapping the screen.

Class 1), traditional drums are loud instruments and are not always usable in dense housing environments or late at night.

Classes 1) and 2) share the drawback of their size and complexity to set up. The usual modern rock or jazz drum kit necessitates a car or bigger vehicle for transport. It is cumbersome to disassemble and reassemble, tasks that commonly take tens of minutes.

For a rock or jazz band that does not own a permanent studio, this is the foremost obstacle to organising rehearsal sessions. Classes 1) and 2) are also expensive musical instruments, with starting prices in the hundreds of pounds.

The main drawback of class 3) and 4) devices is that they do not give the drummer the range of musical expression that class 1) drums do. Their layout is not compatible with the wide arm motions commonly used in drumming.

Compromises in pad design for portability/flexibility also makes them less sensitive to variations in drumming accents. Touch-screen devices are even less able to capture accents.

Both class 3) and 4) devices require the addition of switch pedals to capture foot drumming. These can be cumbersome and expensive, like the pedals used in class 2) devices, if they are to emulate the musical expression capacity of class 1) instruments.

Systems have been proposed for drumming without the need for surfaces to hit. The Airdrums, invented in 1986 by Palmtree Instruments, used electronic wands containing accelerometers. They did not meet commercial success, possibly because drummers felt that the weight of the wands was too cumbersome.

Several newer products aimed at the toy market, such as the Silverlit V Beat Drumsticks and the MiJam Pro Air Drummer, have appeared since. The range of expression they provide is very limited and they suffer from the same drawback as the original Airdrums.

In 2006, the Virtual Drums system was demonstrated by French students that uses two cameras to reconstruct the 3D location of drumstick tips over time. They use this information to detect collisions with virtual drumming surfaces arranged in 3D space to mimic the layout of a rock drum kit, and play back the corresponding drum sounds. This approach is very unintuitive for a drummer.

Embodiments of the present disclosure aim to enable a person drum without the need for physical surfaces to hit, while providing a level of musical expression on par with physical percussion instruments. Embodiments of the present disclosure observe the drumming gestures of the user and analyse them to produce the drum sounds that the user intends.

In an aspect there is provided a musical instrument comprising: an imager arranged to provide a series of two dimensional images of an operator of the musical instrument; a processor, coupled to receive the images, wherein the processor is operable to determine the position of at least two markers in the images and the processor is configured to distinguish between each of the at least two markers in a selected image based on at least one of: the position and/or size of markers in the selected image, and the position and/or size of markers in at least one preceding image of the series of images; and the processor is configured to trigger an audio output signal based on the movements and/or position of at least one of the markers. The processor may be configured so that, in the event that at least one of the markers completes a selected sequence of movements, the processor selects an audio signal for output based on the determined two dimensional position of the marker and/or imaged size of the marker.

In an aspect there is provided a musical instrument comprising: an imager arranged to provide a series of two dimensional images of an operator of the musical instrument; a processor coupled to receive the images and configured to determine the position of a marker in the images and, in the event that the marker completes a selected sequence of movements, to select an audio signal for output based on the position of the marker in the image and/or the imaged size of the marker; and the processor is configured to trigger an audio output signal based on the movements and/or position of at least one of the markers. These and other aspects and examples of the disclosure may enable the processor and imager to infer three-dimensional position information from a series of two-dimensional images, such as those collected from a single camera.

The processor may be configured to store an indication of the position and/or size of a marker in an image of the series for use in distinguishing between at least two markers of a subsequent image of the series. The processor may be configured to identify whether each marker present in an image was also present in a preceding image of the series, and to store an indication of the presence or absence of each marker in the preceding image. The processor may be configured to determine, for each marker that was present in the preceding image, whether that marker was also present in a second preceding image and to determine the change in position and/or the change in size of the marker between the two preceding images, and in which the processor is configured to distinguish between at least two markers based on at least one of said changes.

The selected sequence of movements may comprise at least one reversal in the movement of a marker. A reversal may comprise the marker moving in a first direction for at least a selected first number of images, followed by a movement in a second direction, opposite to the first direction for at least a selected second number of images. The processor may be configured to provide an audio output signal timed to coincide with the at least one reversal. The audio signal may be triggered only in the event that an estimated speed of the marker prior to the reversal exceeds a selected threshold speed, and the processor may be configured to control the volume of the audio signal based on the speed of the marker.

The imager may comprise a camera, such as a digital camera, and in some examples the imager may consist solely of only a single camera, in which case the images consist solely of a series of images collected from that single camera.

The marker may comprise a retro-reflector carried by the operator and the instrument may further comprise a lamp positioned in proximity to the imager so as to illuminate the imager by reflecting light from the retro-reflector when, in use, the retro-reflector is arranged to direct light towards the imager. The retro-reflector being arranged to direct light towards the imager enables the retro-reflector to be visible (e.g. detected and/or imaged) by the imager.

The imager may comprise a digital camera coupled to a wide angle conversion lens.

In an aspect, to configure the musical instrument, the processor may be configured to communicate an indication of an audio signal to a user, and to store an association between the audio signal and the position and/or size of a marker in response to the marker completing a selected sequence of movements. This indication of an audio signal may comprise the name and/or another visual indication of a musical instrument, e.g. the name "high hat", or a picture of a "high hat".

The selected sequence of movements may comprise at least one reversal in the movement of the marker, and selecting an audio signal for output may comprise selecting the audio signal based on the stored association.

In an aspect there is provided a computer implemented method of processing images to control audio signals so as to simulate a musical instrument, the method comprising: receiving a series of two dimensional images of an operator of the musical instrument; determining the position of at least two markers in the images; distinguishing between each of the at least two markers in a selected image based on at least one of: the position and/or size of markers in the selected image, and the position and/or size of markers in at least one preceding image of the series of images; and triggering an audio output signal based on the movements and/or position of at least one of the markers.

The method may comprise selecting an audio signal for output based on the determined position of the marker and/or the size of the marker in the event that at least one of the markers completes a selected sequence of movements. The method may also comprise processing images to control audio signals so as to simulate a musical instrument, the method comprising: receiving a series of two dimensional images of an operator of the musical instrument; determining the position of a marker in the images and, in the event that the marker completes a selected sequence of movements, selecting an audio signal for output based on the position of the marker in the image and/or the imaged size of the marker; and triggering an audio output signal based on the movements and/or position of at least one of the markers.

The method may comprise storing an indication of the position and/or size of a marker in an image of the series for use in distinguishing between at least two markers of a subsequent image of the series. The method may comprise identifying whether each marker present in an image was also present in a preceding image of the series, and storing an indication of the presence or absence of each marker in the preceding image.

The processor may be configured to determine, for each marker that was present in the preceding image, whether that marker was also present in a second preceding image and to determine the change in position and/or the change in size of the marker between the two preceding images, and in which the processor is configured to distinguish between at least two markers based on at least one of said changes. The audio signal may, in some examples, be triggered only in the event that an estimated speed of the marker prior to the reversal exceeds a selected threshold speed.

Embodiments of the disclosure may comprise a computer program product operable to program a processor to perform any method described herein, and/or an electronic message comprising a computer program operable to program a processor to perform such a method.

The disclosure also provides a kit for adapting a computer to provide a musical instrument, the kit comprising: a wide angle lens adapter for a digital camera and a lamp, coupled to the wide angle lens adapter so as to illuminate the wide angle lens adapter by reflecting light from a retro-reflector when, in use, the retro-reflector is directed towards the adapter. The kit may further comprise at least one retro-reflector to be carried by a user, and/or a computer program product to program a processor to perform any method described herein.

Features of the methods disclosed herein may also be embodied in apparatus configured to perform the method steps described. In addition, features of the apparatus may be provided by method steps.

There is also disclosed a musical percussion instrument based on motion capture and analysis. In this example, markers held or worn by the musician are observed by an imager to produce a series of two dimensional images over the time of the performance. The images may be received by a processor. The processor can be configured to distinguish between the different markers (e.g. left hand, right hand, right foot) by comparing the position and/or size of the un-identified markers in the current image to the position and size of identified markers in the previous images. The processor may analyse the movement of each marker over time and detect a drum hit when a marker undergoes a sharp reversal of its motion direction after having reached a sufficient speed (e.g. a speed greater than a selected threshold). The processor may determine which drum the musician intends to hit by comparing the position and size of the marker at the instant of the hit to the position and size attributes of each drum. The position and size attributes of each drum may be pre-determined and can be set by the musician before the performance according to a procedure disclosed in the application. The processor may trigger and output audio signals when drum hits are detected, e.g. virtual "drum hits" detected based on the user completing a selected series of movements. The processor may select the nature of each audio signal according to which drum it determined was hit. The volume of the audio signal may be computed by the processor as a function of the speed of the marker that triggered the drum hit in the instants before the hit.

A first aspect of the disclosure provides an apparatus for capturing part of the motion of the user's drumsticks- or hands- and feet. It comprises:

- retro-reflective or luminous markers to be placed at the tip of each drumstick or on a finger of each hand, and at the top of each foot;
- a digital camera;
- a computer or device capable of executing a computer program, receiving data, playing sounds and displaying visual information; and a computer program.

The apparatus may also comprise a lamp configured to illuminate the markers during a drumming session. The lamp may be configured to illuminate all of the markers and/or to illuminate the markers at all times during a drumming session. The use of a lamp is of particular advantage where the markers are retro-reflective.

The camera may be configured to observe the markers during the session and to continuously capture pictures; in these embodiments the camera transmits each picture it captures to the computer; and the computer program processes each picture to infer the 2D position and size of each marker within each picture; and the computer program analyses changes in marker positions and sizes over time (previous consecutive pictures) to infer whether or not to play sounds at the current time (current picture), and the nature and intensity of those sounds. Capturing pictures continuously may comprise capturing pictures at a selected frame rate. The camera may be configured to transmit each picture to the computer within a selected time period, for example "immediately"—which should be taken to include transmission performed as quickly as the camera is able, e.g. within a time period fixed by the inherent latency of the process performed by the camera.

An advantage of this apparatus over prior art is its simplicity due to the lack of need to recover 3D motion.

A second aspect of the disclosure provides a description of the gesture that enables the user to convey their drumming intent with an apparatus such as the one presented above. This description encompasses the frame of mind that the user can adopt to reproduce the gesture in an intuitive fashion.

The gesture may comprise a downward swing as in normal drumming, followed by a sudden locking of the relevant joints at the instant of the intended drum hit. For a drumstick or hand hit, the relevant joints are shoulder, elbow, wrist and finger joints. For a foot hit, the relevant joints are hip, knee, ankle and toe joints. This gesture may be referred to as the drumming gesture.

The frame of mind that a user can adopt to execute this gesture intuitively in a way that expresses their musical intent, consists in pretending to encounter an obstacle during the downward swing of the drumstick, hand or foot, thus mimicking the sudden stop of the drumstick, hand or foot that would result.

When an obstacle is actually present, such as when the user mimics a bass drum hit with their heel on the floor, thus hitting the floor with the ball of their foot, the resulting motion pattern of the corresponding marker is similar to the one that would be generated by the drumming gesture described above. Embodiments of the disclosure may therefore be able to recognise the drumming intent in that case as well.

An advantage of this gesture over an approach that consists in checking intersections with virtual drumming surfaces, is that it overcomes the drawbacks caused by the lack of visual and haptic feedback. Embodiments of the disclosure may avoid the need for the user and/or the apparatus to locate a virtual surface, and may also improve the timing of drum hits and may enable accents to be conveyed more accurately. The term "drum" may include any drum kit element, including cymbals.

A third aspect of the disclosure provides a process by which the user can calibrate the apparatus to match their drumming conditions. It comprises: a placement phase in which the computer program guides the user in placing the lamp and camera to match the space where they intend to drum; and a drum kit configuration phase in which the computer program lets the user choose the components of their drum kit and guides them in placing those components within the space where they intend to drum.

A fourth aspect of the disclosure provides a process to let a user navigate and choose from computer menus by way of an application of the recognition of the drumming gesture (second aspect) by the apparatus (first aspect). It comprises: the displaying of menu items by the computer, in either a visual or auditory form the interpretation of a drumming gesture as the selection of a menu item if the location and size of the relevant marker when the gesture is recognised match those that were attributed to the menu item.

A fifth aspect of the disclosure provides a process by which the computer program automatically generates and displays standard music notation for the drumming session at the same time as the user is drumming it.

Embodiments of the disclosure will now be described, by way of example only, with reference to the accompanying drawings, in which.

Figure 1:
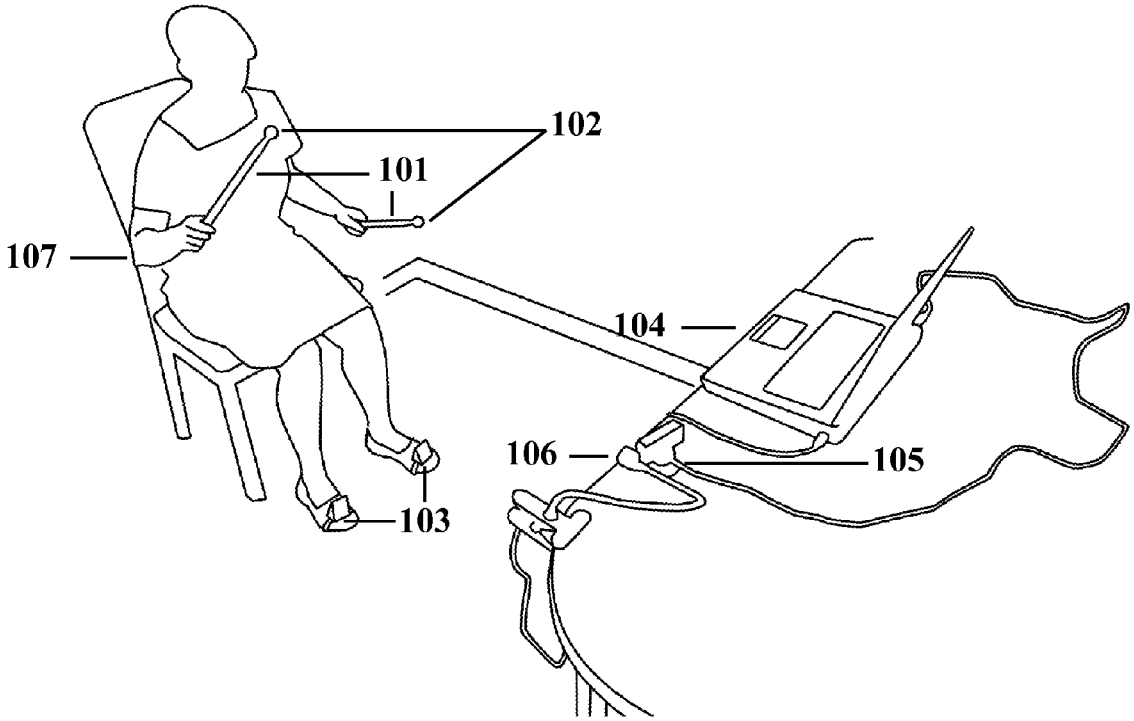
FIG. 1 shows an embodiment of the apparatus being used to drum.

FIG. 1 shows an apparatus comprising: drumsticks 101; drumstick tip retro-reflective markers 102; foot pieces 103; a computer 104; a camera 105; and a lamp 106. The drumsticks 101 are of any type commonly used by rock or jazz drummers. They may also be of any type ordinarily used by other percussionists, such as a mallet.

Figure 2:
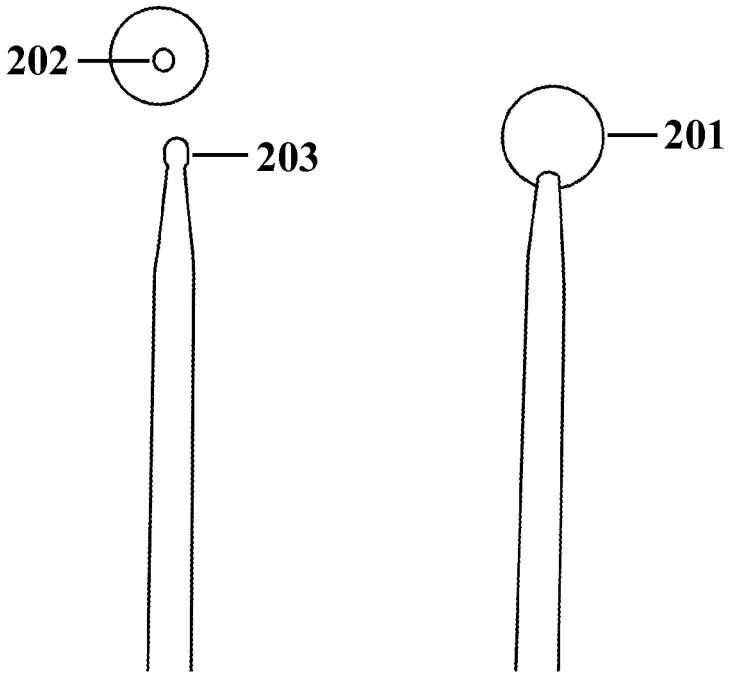
FIG. 2 shows an embodiment of the part of the apparatus placed at the tip of the user's drumsticks, referred to herein as "drumstick markers"

As illustrated in FIG. 2, each drumstick tip retro-reflective marker 102 comprises an expanded polystyrene body 201 of width 3 cm, covered with strips of retro-reflective adhesive tape (3M High Gain Reflective Sheeting 7610). In FIG. 2 each marker attaches to a drumstick by means of a hole slightly smaller than the tip 203 of the drumstick. Each marker may additionally be glued to a drumstick using polystyrene glue or acrylic paint or any appropriate adhesive.

The material used for the marker body may be plastic, rubber, wood or cotton. The diameter of the marker may be within the 0.8 cm to 8 cm range.

The retro-reflective material may consist of a different tape, or of a paint or coating. The markers may comprise balls, although this is merely an example and other markers of other shapes of may be used.

Alternatively or additionally, the drumstick tip markers may be luminous. In that case, the marker body is hollow and made of a translucent material such as thin plastic. A lamp such as one or several light emitting diodes is placed within the hollow of the marker body. The lamp may be powered by common consumer batteries placed on or inside the drumstick or marker.

The drumsticks may be dispensed with and the markers placed on a finger of each hand. The marker may then consist of a thimble-like object with a smooth marker shape. It may be retro-reflective or luminous. In the luminous case, the battery may be placed on the wrist by way of a wrist band if not placed within the marker.

Figure 3:
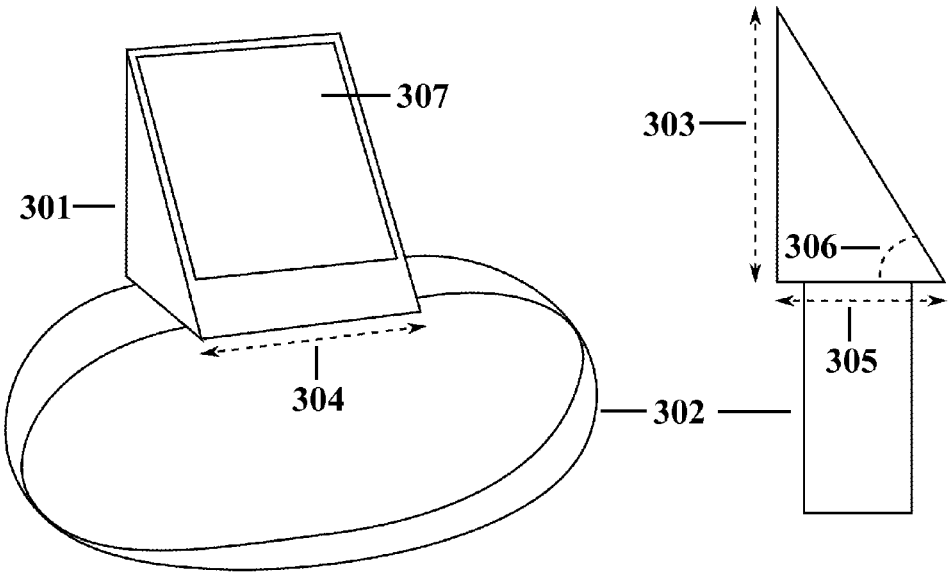
FIG. 3 shows an embodiment of the apparatus component placed on each foot of the user and comprising a foot marker, referred to herein as the "foot piece"

In the example of FIG. 3, each foot piece comprises a wedge shaped block of foam 301 attached to an elastic band 302. As illustrated in FIG. 1, each foot piece 103 attaches to a foot of the user by wrapping the elastic band around the ball of the foot so that the wedge shape rests on the top of the foot. The elastic band 302 is made of elastic fabric 3 cm wide, of circumference at rest of 13 cm and of circumference fully extended of 26 cm.

In the example of FIG. 3, the dimensions of the wedge shape are 5.7 cm in height 303, 5.2 cm in depth 304, and 4 cm in base width 305. These dimensions are chosen so that the side of the wedge facing away from the user when worn makes an angle theta 306 with the vertical of 35 degrees. A square patch of retro-reflective material 307 of dimensions 5 cm by 5 cm is placed on the side of the wedge facing away from the user.

The part of the foot piece resting on top of the foot may have any material and shape that ensures that the side of the foot piece facing away from the user when worn makes an angle theta 306 with the vertical between 10 degrees and 60 degrees. The dimensions of the shape may be between 2 cm and 15 cm in height 303, between 2 cm and 8 cm in depth 304, and between 2 cm and 6 cm in base width 305. The retro-reflective patch may have any concave shape of area between 1 square cm and 10 square cm. The dimensions of the elastic band may be between 0.2 cm and 6 cm in width. Its circumference may be chosen to match the range of foot circumferences observed in children and adults of both sexes. A size adjustment loop may be fitted to the elastic band.

Each foot piece may be luminous rather than retro-reflective. The part of the foot piece resting at the top of the foot may be hollow and made of a translucent material such as plastic. A lamp such as one or several light emitting diodes and standard consumer batteries powering it may be placed within this part.

For the remainder of this document the drumstick or finger markers are referred to as hand markers, and the foot piece markers as foot markers.

The computer 104 may be any device that is capable of:

executing a computer program;

rendering sounds to an audio output or internal speakers;

displaying visual information on a screen; and receiving data such as frames captured by a digital camera;

The computer 104 may also be capable of powering devices and performing data input/output through a USB port.

Figure 4:
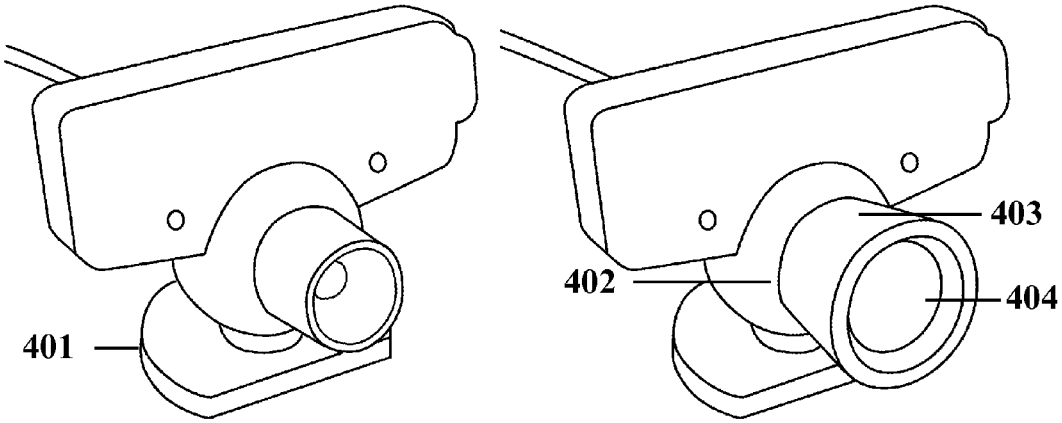
FIG. 4 shows an embodiment of the camera component of the apparatus, with and without an embodiment of an optional wide angle conversion lens attached to it.

In the example of FIG. 4, the digital camera 401 consists of a Sony Playstation Eye, equipped with a wide angle conversion lens 402. However, the digital camera may be of any type. In some examples the camera is operable to capture pictures of resolution greater than 160 by 120 pixels and/or to capture pictures at a rate greater than 100 Hertz, and/or to transmit the pictures taken to a receiving device with a latency lower than 10 ms.

In some examples the vertical and horizontal fields of view of the camera is greater than 60 degrees, and in these and other examples the wide angle conversion lens may be unnecessary.

The wide angle conversion lens 402 may comprise:

a foam conical lens holder 403; and a glass plano-concave lens 404 of diameter 23 mm and focal length −50 mm;

The wide angle conversion lens may be any device that can extend the field of view of the chosen camera beyond 60 degrees vertically and horizontally.

Figure 5:
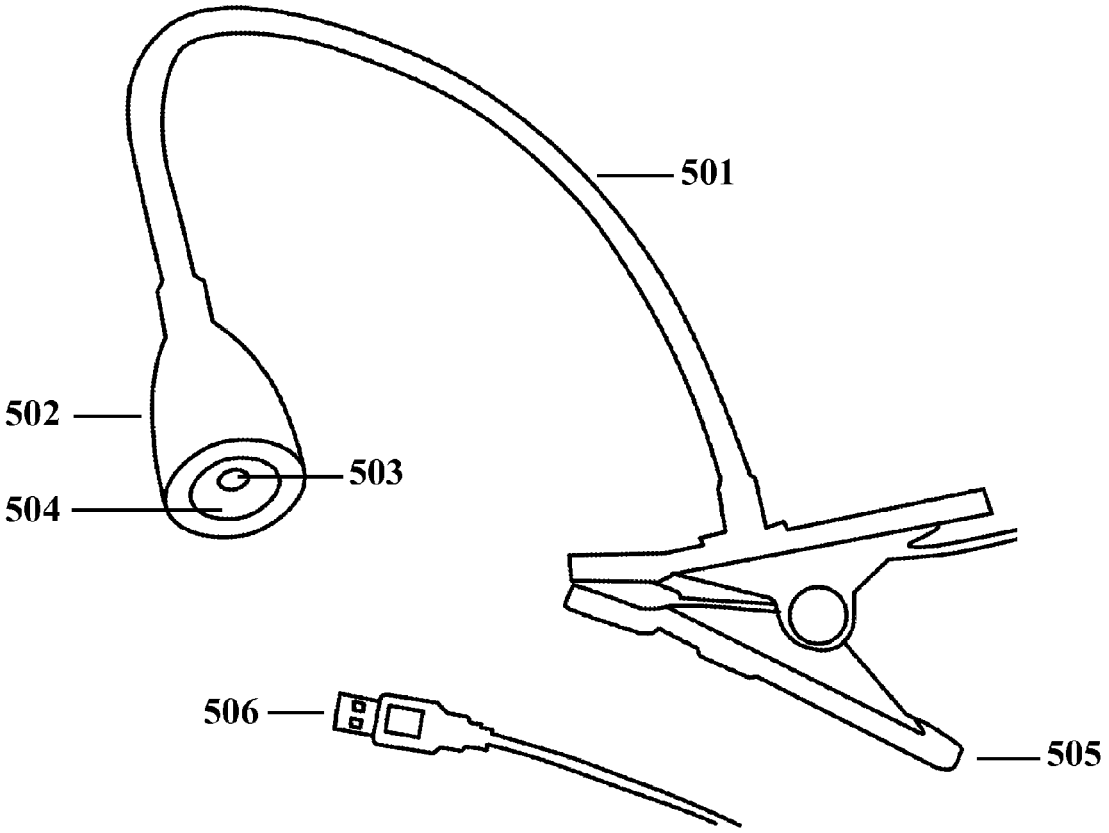
FIG. 5 shows an embodiment of the lamp part of the apparatus.

In the example of FIG. 5, a lamp 106 comprises a 30 cm long flexible stem 501, a lamp head 502 of length 3 cm and greater diameter 3 cm, a 2 W white light emitting diode 503, a lens 504 ensuring an illumination cone of 90 degrees, a table clamp 505; and a USB power cord and plug 506.

The lamp may be provided by any light source. In some examples the lamp comprises a light source operable to emit light from a volume in space smaller than 64 cubic centimeters, and/or operable to be conveniently placed so that the light emitting part is at a distance less than 2 cm from the lens of the digital camera and/or operable to provide an illumination cone wider than 60 degrees, and/or has a Lumen rating above 150 lumen;

The light emitted by the lamp may not be in the visible spectrum, for example it may be infra-red, and the camera may be configured to be sensitive to light within the lamp's spectrum. The different components of the apparatus may be configured so as to ensure that the computer program receives pictures that contain all the markers at each instant of the drumming session. The markers may be assumed to remain within a volume corresponding to playing on a modern rock drum kit. This volume is referred to in the remainder of this document as the "drumming volume".

FIG. 1 illustrates one such configuration. In the example of FIG. 1 the camera 105 is placed facing the user 107, or at a horizontal angle not greater than 45 degrees to the direction towards which the user's torso is facing. The camera 105 is placed within a height range between 0 cm and 2.5 m above the ground, in such a way that its support does not obstruct its view of the markers, e.g. on the edge of a standard desk. The feet of the user 107 are located at a ground distance between 50 cm and 3 m to the camera 105. The camera is rotated so that the pictures it takes encompass the drumming volume. For ease of rotation, the base of the camera allows for vertical tilt.

In the example of FIG. 1, the camera is plugged into one of the computer's 104 USB ports. The camera may be powered through mains or its own batteries, and may transmit the pictures to the computer via a wireless interface such as WiFi® or Bluetooth®.

In the example of FIG. 1, the lamp 106 is placed so that its head 502 is adjacent to the camera lens 402, and so that its illumination cone encompasses the drumming volume e.g. it faces in the same direction as the camera lens 402. The table clamp 505 and the flexible stem 501 may facilitate this placement. The lamp is plugged into one of the computer's 104 USB port for power. Additionally or alternatively the lamp 106 may be powered through mains or its own batteries.

Figure 6:
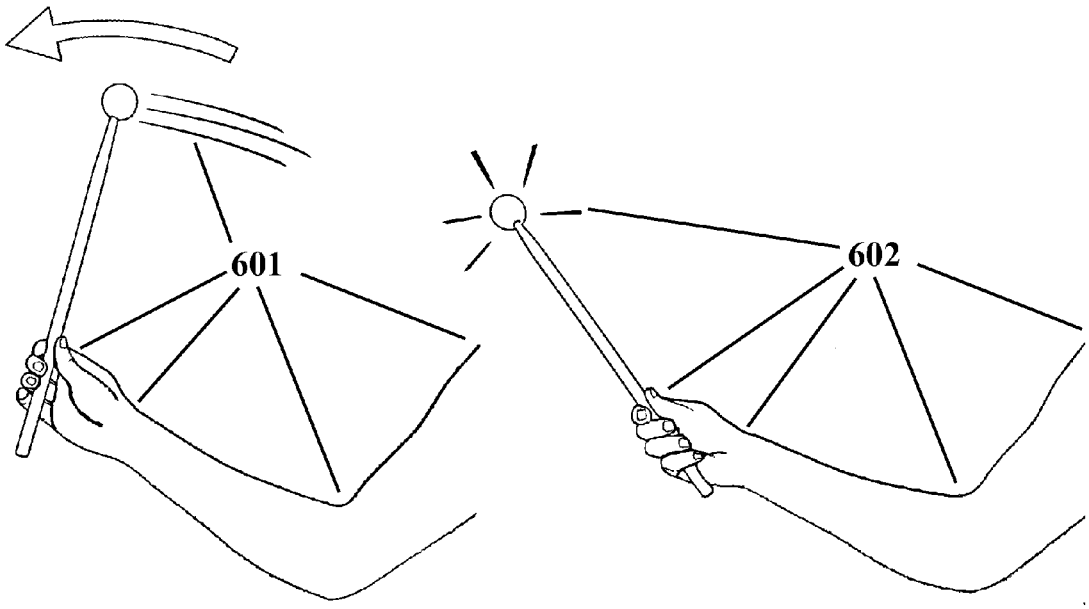
FIG. 6 shows the drumming gesture used to signify a drum hit.

FIG. 6 illustrates one drumming gesture that embodiments of the disclosure may be configured to recognise, for example where the user is drumming with a drumstick. The user swings 601 the drumstick downwards as if they were aiming to hit a normal drum. At the instant at which they want the drum sound to be produced (i.e. to hit the drum), they suddenly stop 602 the motion of the drumstick tip by locking their shoulder, elbow, wrist and finger joints. To reproduce this gesture in an intuitive manner, the user may think of it as mimicking what would happen if the drumstick tip had hit the surface of a physical drum while performing a normal swing as if playing on a physical drum kit. When drumming without a drumstick, the gesture is identical except for the configuration of the fingers, which are not holding a stick. The user may think of the gesture as pretending to hit a hand drum with their hand. When the marker is placed on the thumb, the user may also think of the gesture as mimicking playing with an imaginary drumstick.

The drumming gesture when using the foot is the exact counterpart of the stick or hand drumming gesture; the joints that have to be locked at the instant when a drum sound is desired are the hip, knee, ankle and toe joints. To reproduce this gesture in an intuitive manner, the user may think of it as mimicking what would happen when a physical drum foot pedal reaches the end of its course while depressing it.

In some examples, the user will hit the floor with the ball of their foot at the end of the foot drumming gesture, thus making it very similar to using an actual foot pedal. This is not strictly necessary: a user may perform the gesture with their foot remaining in the air, as long as they stop the motion of the ball of the foot at the desired instant by locking the joints mentioned above. Examples of this are when drumming while standing on one foot, or while seated with one leg resting on the other knee.

The foot piece marker may be replaced by a marker attached to the ankle, knee or thigh with an elastic band. In that case, the foot drumming gesture consists in hitting the floor with the heel while the ball of the foot remains on the floor. This causes the motion of the ankle, knee or thigh marker to have a pattern equivalent to that of the drumming gesture described above. Such a marker location is also suitable to detect drumming gestures that originate with the thigh joint.

Figure 7:
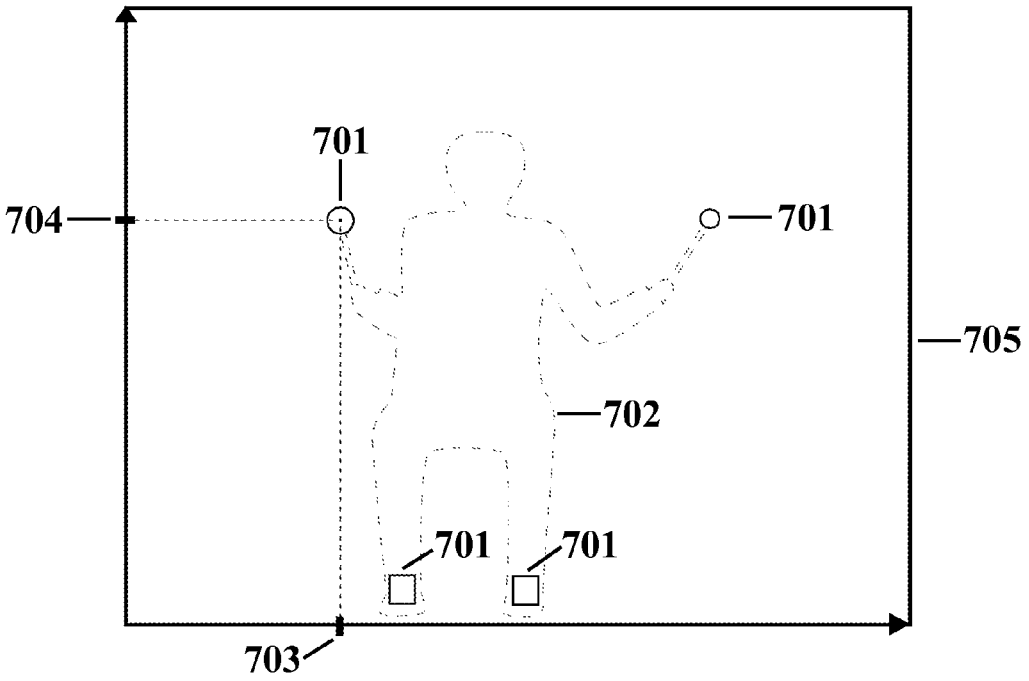
FIG. 7 shows a drawing of a typical picture captured by the camera during a drumming session.

FIG. 7 illustrates the characteristics of the pictures that the camera 105 continuously transmits to the computer 104 and that are continuously analysed by the computer program. During a drumming session, markers 701 may be present within each picture 705. Because of their retro-reflectivity and of the positioning of the lamp head 502 near the camera lens 402, the markers appear brighter than the remainder of the picture 702. This is also the case where luminous markers are used and the lamp is dispensed with. The camera's exposure setting is set low to minimise motion blur during fast drumming gestures.

The computer program extracts the position and size of markers from each picture received from the camera in turn according to the following algorithm:

1. A binary threshold is applied to the picture to conserve the brighter pixels corresponding to the markers (marker pixels) and discard the darker pixels corresponding to everything else. Some pixels are labelled as dead pixels and discarded regardless of how bright they are.

2. A blob extraction algorithm is applied to group the bright pixels into connected components. The algorithm iterates through each line of the picture to extract connected segments of marker pixels. Those segments are grouped together with segments of the previous line to form connected components if they overlap. The number of pixels of each connected component is updated when new segments are added to it.

3. The four bigger connected components in terms of pixel count are chosen to correspond to the four markers. Each marker's size (radius in pixels) is computed as $\sqrt{(c/\pi)}$ where c is the pixel count of the connected component corresponding to the marker. Each marker's 2D position is computed as the centre of mass of the pixels belonging to the connected component corresponding to it, expressed in picture coordinates (x 703, y 704). The position coordinates (and size) of each marker are stored as floating point numbers, since the centre of mass of a connected component comprising many pixels allows for sub-pixel accuracy.

The drum stick markers may be dispensed with. The computer program may implement a segmentation algorithm to isolate the pixels belonging to the drumsticks, then fit a model (e.g. a line segment) to each resulting connected component. The position of a virtual marker can then be inferred by the configuration of the model in each picture (e.g. end of the segment). The number of pixels in each stick connected component may be used as the virtual marker's size. Such an approach may become the most practical as the characteristics of digital cameras improve with technological progress.

Marker Identification Algorithm

After the markers have been extracted from the current picture, the computer program executes the following algorithm to identify the nature of each marker (i.e. left hand, right hand, left foot, right foot):

A) For each marker, if it was present in the previous picture, store its position and size in the previous picture (x_previous, y_previous, s_previous). Otherwise store a flag indicating that it was absent. The marker's position and size in the current picture are referred to as (x_current, y_current, s_current).

B) For each marker that was present in the previous picture: If it was also present in the second to last picture, store its position displacement and size change from the second to last picture to the previous picture dx_previous=x_previous−x_second_to_last, dy_previous=y_previous−y_second to_last and ds_previous=s_previous−s_second_to_last, where $x$_second_to_last,$y$_second_to_last and $s$_second_to_last are the coordinates and size of the marker in the second to last picture.

Otherwise, store a flag indicating that it was absent in the second to last picture.

C) For each marker present, if the y coordinate 704 of its position in the picture is greater than a certain value y_hand, classify it as a hand marker. Otherwise, classify it as a foot marker.

$y$_hand=$y$_min+($y$_max−$y$_min)/4, where y_max is the y coordinate 704 of the highest marker in the picture, and y_min that of the lowest marker.

D) For each current picture marker mi classified as hand, for each marker mj classified as hand in the previous picture, compute a distance d_mi_mj: If the previous picture marker mj was also present in the second to last picture, the following formula is used:

$d_mi_mj$=($x$_previous_$mj$+$dx$_previous_$mj$−$x$_current_$mi$)2+($y$_previous_$mj$+$dy$_previous_$mj$−$y$_current_$mi$)2+$W2_s$($s$_previous_$mj$+$ds$_previous_$mj$−$s$_current_$mi$)2

Otherwise, the following formula is used:

$d_mi_mj$=($x$_previous_$mj$−$x$_current_$mi$)2+($y$_previous_$mj$−$y$_current_$mi$)2+$W2_s$($s$_previous_$mj$−$s$_current_$mi$)2

In both formulas, the suffixes_mi and _mj are used to refer respectively to the attributes of the current picture hand marker mi and of the previous picture hand marker mj.

E) There are four possible numbers of distances d_mi_mj to compute, giving rise to the following mutually exclusive cases:

1. There was not a single distance d_mi_mj to compute: either there is no hand marker in the current picture, in which case the identification problem is trivial, or there were no hand markers in the previous picture. In that case, if there are two hand markers in the current picture, the one whose x coordinate 703 is highest is identified as the left hand marker and the other one as the right hand marker. If there is only one hand marker in the current picture, it is identified as the left hand marker if its x coordinate 703 is greater than a certain value x_handedness, and as the right hand marker if not.
2. There was only one distance d_mi_mj to compute. In that case, there was one hand marker in the previous picture and there is one marker in the current picture. The current picture hand marker is given the identity of the previous picture hand marker.

3. There were two distances d_mi_mj to compute, corresponding to the following two mutually exclusive possibilities:
   a) There are two hand markers in the current picture and there was one hand marker in the previous picture. In that case, the current picture hand marker mi corresponding to the smallest of the two distances d_mi_mj is given the identity of the previous picture hand marker mj. The other current picture hand marker is given the remaining identity. For example, if the first marker was identified as "left" then the second marker is identified as "right".
   b) There is one hand marker in the current picture and there were two hand markers in the previous picture. In that case, the previous picture hand marker mj corresponding to the smallest of the two distances d_mi_mj gives its identity to the current picture hand marker mi.
4. There were four distances d_mi_mj to compute, in this case there are two hand markers in the current picture and there were two hand markers in the previous picture. Let m1 and m2 be the current picture hand markers, and m3 and m4 be the previous picture hand markers. If d_m1_m3+d_m2_m4 is lower than d_m2_m3+d_m1_m4 then marker ml is given the identity of marker m3 and marker m2 is given the identity of marker m4. Otherwise, marker m2 is given the identity of marker m3 and marker ml is given the identity of marker m4.

F) Perform steps D and E above, substituting the word 'hand' with the word 'foot'.

Possible Refinements of Marker Identification Algorithm

The computer program may implement the following heuristic to further enforce the correct identification of a hand marker as corresponding to the left or right hand.

1. If a marker is currently identified as a right hand marker and its x coordinate 703 becomes greater than a pre-defined value x_right_limit, then it becomes identified as a left hand marker.

2. If a marker is currently identified as a left hand marker and its x coordinate 703 becomes greater than a pre-defined value x_left_limit, then it becomes identified as a right hand marker.

3. If a marker swaps identity because of step 1 or 2, the computer program does not reset its position and size history, but transfers it to its new identity. Additionally, if another hand marker was present, its identity is similarly swapped.

The heuristic above may comprise a check of what drum kit element is deemed reachable by a specific hand. For example, the drumstick held in the left hand is deemed to be usable to hit all drums elements except for the ride cymbal and floor tom. If that check fails for any drum hit for a given hand marker, then the hand marker is swapped as above.

To deal with the case where two hand markers overlap in the current picture, the computer program implements the following algorithm, which is run for each picture before the marker identification algorithm:

1. If a single hand marker was found in the current picture, and if two hand markers where present in the previous and in the second to last picture, compute a distance d' according to the following formula:

$$d'=(x1_previous+dx1_previous-(x2_previous+dx2_previous))2+(y1_previous+dy1_previous-(y2_previous+dy2_previous))2+W2_s(s1_previous+ds1_previous-(s2_previous+ds2_previous))2$$

where x1_previous, dx1_previous etc. are defined as $$dx_previous=x_previous-x_second_to_last,$$
$$dy_previous=y_previous-y_second_to_last$$

and $$ds_previous=s_previous-s_second_to_last,$$

where x_second_to_last, y_second_to_last and s_second_to_last are the coordinates and size of the marker in the second to last picture, with 1 indicating the first marker and 2 the second marker.

2. If d' is lower than a predefined value d_overlap:
   a) Compute the width w and height h in pixels of the connected component corresponding to the single hand marker.
   b) If w/h is greater than a pre-defined value a_overlap, the connected component is split along the vertical axis into a left half and a right half of equal width. Each half is treated as a distinct connected component corresponding to a distinct marker, and each marker's position and size are computed as $\sqrt{(c/\pi)}$ where c is the pixel count of the connected component corresponding to the marker. Each marker's 2D position is computed as the centre of mass of the pixels belonging to the connected component corresponding to it, expressed in picture coordinates (x 703, y 704). The position coordinates (and size) of each marker are stored as floating point numbers, since the centre of mass of a connected component comprising many pixels allows for sub-pixel accuracy.
   c) Else, if w/h is lower than 1/a_overlap, the connected component is split along the horizontal axis into a top half and a bottom half of equal height. The halves are treated as in b) above.
   d) Else, the connected component is treated as corresponding to two distinct markers of identical position and size, computed as $\sqrt{(c/\pi)}$ where c is the pixel count of the connected component corresponding to the marker. Each marker's 2D position is computed as the centre of mass of the pixels belonging to the connected component corresponding to it, expressed in picture coordinates (x 703, y 704). The position coordinates (and size) of each marker are stored as floating point numbers, since the centre of mass of a connected component comprising many pixels allows for sub-pixel accuracy.

In some examples it is assumed that foot markers never overlap during a drumming session.

The computer program analyses the evolution of each identified marker's position and size over time to determine what sounds to play, at what time and at what volume.

Figure 8:
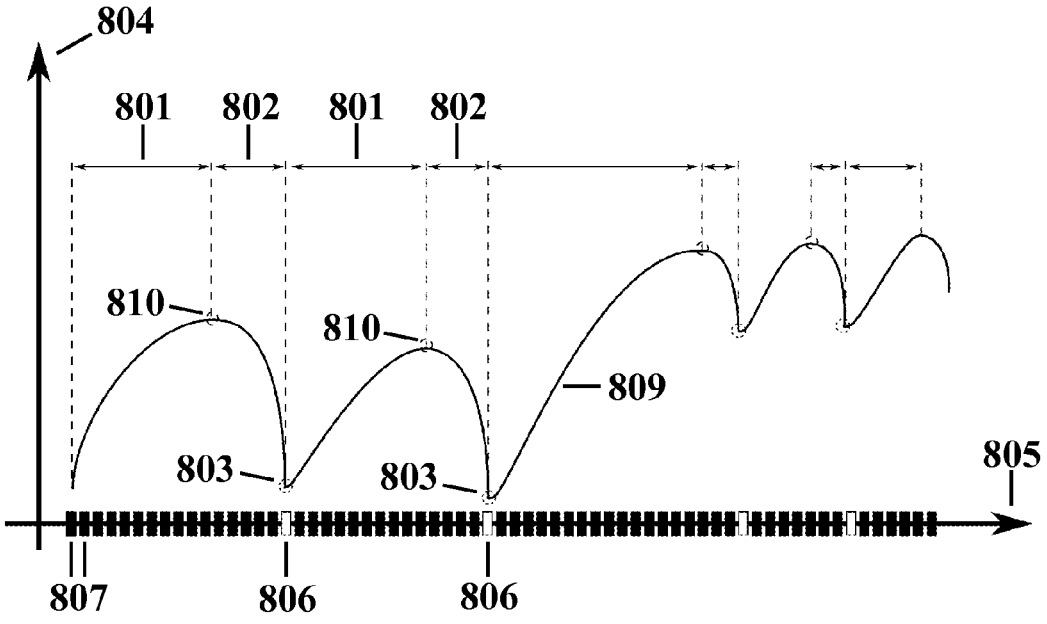
FIG. 8 shows a graph of the y coordinate in picture space of a marker during a series of drumming gestures.

FIG. 8 illustrates with a graph 809 the typical evolution of the y coordinate 704 804 of a marker in the series of pictures 807 received over time 805 by the computer program during a series of drumming gestures.

There is always an upwards arming motion 801 before the swing, followed by the downward swing 802, followed by a sudden immobilisation of the marker. There cannot be a new intended drum hit without the y coordinate 704 804 having increased first (arming 801). And the y coordinate 704 804 has to have decreased for a pre-defined number min_n_swing of consecutive pictures (swing 802). And the y coordinate has to have exceeded a certain pre-defined minimum speed value S_min. The hit then occurs at the time of the local minimum 803 of the y coordinate 704 804. That is, at the time 805 of the first picture 806 at which the y coordinate 704 804 is identical or lower to what it is in the next picture. The drum sound corresponding to the hit is played as soon as the computer program detects it, that is, at the time of the next picture.

The position and the size of the marker at the time of the hit are used by the computer program to determine which drum was hit and therefore what type of drum sound to play.

For a hand marker, the process is as follows:

1) Each available drum except the bass drums is given a pre-defined 2D position (coordinates) and expected marker size. Let x_d and y_d be the pre-defined coordinates of a drum, and s_d the expected marker size for that drum.
2) For each available drum except the bass drums, a distance D is computed according to the following formula, where x_m and y_m are the coordinates of the marker's position and s_m the marker's size at the instant of the hit:

$$D=\sqrt{((x_m-x_d)2+(y_m-y_d)2+W_s(s_m-s_d)2)},$$

where W_s is a pre-defined weighting factor determining the influence of the marker size difference with respect to the position difference.
3) The drum for which the computed distance D is the smallest is determined to be the drum that was hit, and the corresponding sound is played.

Through this process, embodiments of the disclosure may enable the user to express their intention to hit one drum or the other even if their pre-defined positions within the picture are identical, provided that the expected marker sizes are sufficiently different. An example of this case is when the camera is facing the user: for a drum hit directly in front of the user, the marker size is small if the hit occurs near the user (i.e. far from the camera, arm is folded) and large if the hit occurs far from the user (i.e. near the camera, arm is extended). By using a small pre-defined expected marker size for a tom and a large expected marker size for a cymbal, they can both be placed in front of the user, in a line with the camera, and still allow the user to express which of them they intend to hit.

Foot Drums

In the case where there are only two foot drums, e.g. a hi-hat pedal and a bass pedal, the computer program uses the identity (left foot, right foot, see Marker Identification Algorithm), of the marker to determine which drum is hit.

In the case where one foot controls multiple drums, e.g. a hi-hat pedal and a second bass drum pedal, for the relevant foot marker (e.g. left foot), the foot drums are assigned mutually exclusive pre-defined intervals of x coordinates 703. When a drumming gesture (drum hit) occurs for a foot marker, the computer program determines which interval the x coordinate of the marker belongs to, and thus which drum was hit and what type of drum sound to play.

Determining Properties of Sound Played

The positions and the sizes of the marker during the swing part 802 of the drumming gesture are used by the computer program to refine the nature of the drum sound to play and determine how loud to play it. This lets the user express the accents of their drum hits by making wide and fast, or small and slow drumming gestures.

For a given marker, the swing part 802 of the drumming gesture is defined as the interval between the last local maximum 810 of the y coordinate 704 804 of the marker and the current local minimum 803 that represents the current potential drum hit. A record is kept of the positions and sizes of the marker during its last swing phase: that record is re-initialised upon the first decrease of the y coordinate 704 of the marker after a series of increases.

Upon the first increase of the y coordinate after a series of decreases (swing 802), the record of positions and sizes of the marker for each picture of the swing phase is processed to obtain a marker speed S according to the following formula:

$$S=(\sqrt{((x_end-x_start)2+(y_end-y_start)2+W2_s(s_end-s_start)2)})/n_swing$$

where (x_end, y_end) are the x and y coordinates 703 704 of the marker in the last picture of the swing, (x_start, y_start) are the x and y coordinates 703 704 of the marker in the first picture of the swing, s_end is the size of the marker in the last picture of the swing, s_start is the size of the marker in the first picture of the swing, W2_s is a pre-defined weighting factor determining the influence of the marker size difference with respect to the position difference, and n_swing is the number of pictures comprising the swing phase 902.

The swing speed S may be computed in a different manner. For example by summing pairwise Euclidean distances between positions of the marker in consecutive pictures, summing this with a weighted marker size difference between start and end picture, and dividing by n_swing, the number of pictures comprising the swing phase 802.

Each drum is given a pre-defined minimum speed value S_min and a pre-defined maximum speed value S_max. For a potential drum hit for a given marker (end of drumming gesture), if the computed speed S is lower than the relevant S_min, the gesture is not registered as an actual hit and no sound is played.

If S is greater than or equal to S_min and lower than or equal to S_max, a volume coefficient Vc is computed according to the following formula: Vc=(S−S_min)/(S_max−Smin) This volume coefficient, which is a value between 0 and 1, is used to weight (by multiplication) the relative volume of the drum sound played. It may also be used to determine the nature of the drum sound in the manner described below with reference to the Drum Sound Collection.

Drum Sound Collection

Each drum is represented by a collection of drum sounds that have been pre-recorded in a studio environment. One aspect of this collection is that, for a specific drum, different recordings are made corresponding to different drumming accents (how fast and hard the drum is hit). Let Na be the number of pre-recorded accents for the drum being hit. The computer program computes a series of Na intervals (I_1, I_2, . . . , I_Na) as follows:

$$I_1=[0,1/Na)I_2=[1/Na,2/Na)\ldots I_Na=[(Na-1)/Na,1]$$

The computer program then computes which interval I_i the volume coefficient Vc belongs to, and plays the corresponding sound for that drum (i.e. sound number i). Another aspect of the sound collection for a specific drum is that it contains recordings corresponding to drum hits with the dominant hand and recordings corresponding to drum hits with the non-dominant hand. The computer program tracks which hand a marker corresponds to (see Marker Identification Algorithm), and plays the corresponding sound.

Another aspect of the sound collections is that different versions of each drum sound are stored corresponding to different reverberation configurations. This is achieved by applying different levels of reverb effect to each drum sound recording. This may be achieved by recording the sounds in different physical environments (e.g. house room, theatre). The computer program provides an interface for the user to choose the reverberation configuration in which they wish to play. This configuration can be chosen for all drums at once or for each drum individually.

The sound recordings are normalised in volume to allow for consistent volume gradation when applying the volume coefficients Vc of different drum hits.

For each drum d the computer program uses a variable Vd within the [0,1] interval to represent its relative loudness with respect to the other drums. This coefficient is applied (multiplication) after the drum hit specific volume coefficient Vc is applied.

The computer program provides pre-set values for the Vd of each available drum, as well as an interface to allow the user to adjust each Vd.

When a foot marker's x coordinate 703 is within an interval corresponding to a hi-hat cymbal drum element, the position of that foot marker is processed by the computer program to determine the openness of the hi-hat in the following manner:

The computer program keeps a record of two integer variables hh_min and hh_range. the computer program computes a hi-hat openness value o by examining the y coordinate 704 hh_y of the hi-hat foot marker (see above): if hh_y is lower than hh_min,o=0; if hh_y is greater than hh_min+hh_range, o=1; otherwise, o=(hh_y−hh_min)/hh_range.

The drum sound collection for a hi-hat cymbal contains recordings of the hi-hat being hit with a drumstick at different levels of openness, as well as recordings of the hi-hat being closed with the foot at different speeds.

Let Nhh be the number of pre-recorded openness levels for the hi-hat. The computer program computes a series of Nhh intervals (Ihh__1, Ihh__2, . . . , Ihh_Nhh) as follows:

$$\text{Ihh_1} = [0, 1/Nhh)$$

$$\text{Ihh_2} = [1/Nhh, 2/Nhh)$$

$$\ldots$$

$$\text{Ihh_Na} = [(Nhh-1)/Nhh, 1]$$

When the hi-hat cymbal is hit by a hand marker, the computer program computes which interval the openness value o belongs to, and picks the corresponding type of sound for that level of openness. The properties of the sound played are further determined according to the process set out above—"Determining Properties of Sound Played".

The computer program determines the values for hh_min and hh_range during the drum kit configuration phase. When a foot marker is operating the hi-hat as defined above for "foot drums", the computer program updates the values for hh_min and hh_range in the following manner:

When a hi-hat hit occurs with the foot marker, hh_min is set to the y coordinate 704 of the foot marker at the instant of the hit.

If the foot marker's y coordinate 704 hh_y is lower than hh_min then hh_min is set to hh_y.

If the absolute value of the difference between the x coordinate 703 of the marker at the start of an arming phase 801 or swing phase 802 and its x coordinate 703 at the end of that phase is greater than a pre-defined value hh_side_slip, then hh_min is set to the y coordinate 703 of the marker at the end of that phase. If at the end of an arming phase 810 the y coordinate 704 of the marker hky is greater than hh_min plus hh_range plus a pre-defined value hh_front_slip, hh_min is set to hh_y.

When a foot marker begins operating the hi-hat as defined above for "foot drums" during an arming phase 801, hh_min is set to the y coordinate 704 of the marker at the end of the next swing phase 803 if it is still operating the hi-hat. In the meanwhile, the hi-hat is set to open: o=0.

When a foot marker begins operating the hi-hat (as defined above for "foot drums") during a swing phase 802, hh_min is set to the y coordinate 704 of the marker at the end of the swing phase 803 if it is still operating the hi-hat. In the meanwhile, the hi-hat is set to open: o=0.

Calibration/Configuration

The computer program provides an interface to let the user calibrate the apparatus to match their drumming conditions. This interface comprises two phases. At the beginning of the first phase (placement phase), the computer program instructs the user to place the camera and lamp roughly 50 cm to the right of the computer screen if left handed, or to the left if right handed, and to point them roughly to the location where the user intends to drum, which should be on a line such that the user is facing the computer screen. The computer program then displays in real time the pictures captured by the camera. A number of pieces of visual information are displayed overlaid on top of the current picture:

1. Pixels that are too bright, called dead pixels are displayed in semi-transparent red. Dead pixels correspond to parts of the drumming environment that are brighter than a marker would be, thus hindering the computer program's analysis of the position and size of any marker travelling within the corresponding area.

Dead pixels are computed in the following manner:

a. For each pixel of the picture, compute the maximum light intensity value l_max reached by that pixel over the course of a pre-defined number n_calibration of pictures.

b. For each pixel, if l_max is greater than a certain threshold t_calibration, the pixel is classified as a dead pixel.

2. Dead pixels regions are annotated with text (and a sound or audio message may be played) according to the following algorithm:

a. If there are more than a pre-defined number max_dead_pixels1 of dead pixels, then the text instructs the user to dim the lights or draw the curtains/blinds to make the environment less bright.

b. If there are more than a pre-defined number max_dead_pixels2 of dead pixels, and more than 95% of them are in the left (respectively right) half of the picture, then the text instructs the user to pan the camera and the lamp to the right (respectively left), and an arrow is displayed to that effect.

c. If there are connected components containing more than max_dead_pixels3 dead pixels each, then the text instructs the user to remove or cover the corresponding bright objects in the environment. An arrow is displayed pointing from the text to each of the connected components (and therefore objects).

d. In cases b and c, additional text instructs the user to dim the lights or draw the curtains if it is not practical to pan the camera or remove/cover bright objects.

3. Two semi-transparent rectangular boxes are displayed at the bottom of the picture. One is located one third from the left of the picture and annotated with the text: "feet location for right handed drumming" The other is located one third from the right of the picture and annotated with the text: "feet location for left handed drumming" The computer program instructs the user to pan and tilt the camera so as to cover the location where their feet will be when drumming with the relevant box. For example, if they are right handed, they may tilt the camera so that the box on the left is overlaid over the area in front of the feet of the chair where they intend to seat during the drumming session.

4. A button labelled "configure drums" or other text to that effect is displayed. When activated, the drum kit configuration phase (second phase of the calibration interface) begins. The drum kit configuration phase consists of the following consecutive steps:

a. The computer program displays a menu whereby the user can select a pre-set composition for the drum kit they wish to play. For example a standard rock drum kit with high tom, floor tom, snare, and bass drums, and hi-hat, ride and crash cymbals. The menu alternatively lets the user create the drum kit by repeatedly picking drum elements (e.g. tom drum, 19" ride cymbal, bass drum etc) from a plurality of lists.

b. When the user has made their choice of drum kit, the computer program instructs them to take their intended drumming position, as described with reference to placement of the camera, above, and as configured by them in the placement phase of the configuration/calibration described above.

The computer program also instructs the user to remain still for 2 seconds in a natural drumming posture once at their intended drumming position. In this posture, the user should hold their hands and/or drumsticks so that the markers are:

1. equidistant from their torso
2. below their neck
3. above their waist

In this posture, the user should not cross their arms, wrists, hands or drumsticks.

c. The computer program then continuously checks for the presence of four markers and for their having remained relatively still for a period of 2 seconds. This is done by computing a distance as per the formula $$D=\sqrt{((x_m-x_d)2+(y_m-y_d)2+W_s(s_m-s_d)2)},$$

for each marker between its positions and sizes in two consecutive pictures. If all distances are lower than a pre-defined valued still, a picture counter is incremented, otherwise it is reset to 0. The computer program deems the check passed when the picture counter becomes greater than the number of pictures captured in two seconds, for example 240 if capturing at 120 hertz. The number of markers checked for may be lower than four if the user has selected a drum kit composition with fewer elements. If the user has selected a drum kit composition without drums operated by the feet (e.g. hi-hat, bass drum) then the foot markers are not processed by the computer program at any point and the user does not need to wear them.

d. The computer program computes the y_hand value using the formula y_hand=y_min+(y_max−y_min)/4, where y_max is the y coordinate 704 of the highest marker in the picture, and y_min that of the lowest marker. This places the dividing line between hand markers and foot markers one quarter of the way between the height of the lowest marker and the height of the highest marker. In the initial posture, the lowest marker is assumed to be a foot marker and the highest marker a hand marker.

e. The computer program computes the x_handedness value using the formula x_handedness=(x__1+x__2)/2, where x__1 is the x coordinate 703 of the highest marker in the picture, and x__2 that of the second highest. This places the dividing line between left markers and right markers half way between the two highest markers, assumed to be hand markers in the initial posture.

At this point, the computer is able to identify markers and analyse their trajectory as per the Marker Identification Algorithm and as discussed with reference to FIG. 8.

f. The computer program then instructs the user to place the drum elements by making drumming gestures at the desired locations. Elements are placed one at a time, by making a drumming gesture for each one after the computer has displayed the name of the element to place next. The sound corresponding to the element may be played when its name is displayed. The sound is played when the element is placed (upon the end of the drumming gesture, as during normal drumming) For each drum element, the coordinates (x_d, y_d) and size s_d of the drum (defined above) are set according to the following formulas:

$$x_d=x_placement,$$

$$y_d=y_placement,$$

$$s_d=s_placement$$

where (x_placement,y_placement) are the coordinates of the marker's position and s_placement its size at the end of the drumming gesture it reflected.

In step b, the computer program may give the user the option to skip step 6 and play straight away. If that option is chosen, for each drum element, x_d, y_d and s_d are set to pre-defined values. A symbol representing each drum element is displayed overlaid over the captured pictures at its position (x_d, y_d).

g. If a hit-hat cymbal is present in the drum kit composition, the computer program instructs the user to open and close the hi-hat with the relevant foot. The computer program records the minimum and maximum y coordinates 704 of the corresponding foot marker over the resulting arming 801 and swing 802 phases. hh_min (defined above) is set to the minimum value and hh_range (defined above) is set to the maximum value minus the minimum value.

Once calibration is completed, (e.g. at the end of the drum kit configuration phase), the drumming session may start. The user can drum by making drumming gestures at the appropriate locations and speeds to express their musical intent.

During the drumming session, the computer program displays a menu icon at a y coordinate i_y equal to y_hand (defined above) and a pre-defined x coordinate i_x. This icon is also given an expected marker size i_s that is smaller than all the expected marker sizes of the drum kit being played.

When the user makes a hand drumming gesture, the menu icon is checked for a "drum" hit as if it was another drum, using (i_x, i_y, i_s) as counterparts for (d_x, d_y, d_s) (defined above). To further avoid false positives, the icon is placed on the side of the non-dominant hand and the hit has to be performed with the dominant hand.

If the menu icon is hit, the computer programs enters a menu mode in which the user can control different aspects of the program by making drum gestures. Each menu comprises a set of icons (or labelled areas) representing each option, as well as an icon to go one level up in the menu arborescence, and an icon to exit the menu and return to drumming.

The icons are distributed evenly across the screen to make it easy for the user to discriminate between them by making drumming gestures, in the same fashion that they selected the menu icon.

Menu Options

Menu options may include:

1. Exiting the program to stop drumming
2. Re-starting calibration, either at the placement phase (phase 1) or the drum kit configuration phase (phase 2)
3. Picking a pre-set drum kit or creating a drum kit from lists of elements during the drum kit configuration phase of the calibration
4. Adjusting overall drumming volume 5. Adjusting the volume for a specific drum
6. Adjusting the overall reverberation level
7. Adjusting the reverberation level for a specific drum
8. Operating a built in music player to pick a track to drum along to
9. Saving the recorded drumming session
10. Switching display type (see below)
11. Opening a sheet music file to display while drumming (see below)

When selecting menu options 4, 5, 6 or 7, or any option that would necessitate the input of a continuous value, the computer program checks if a marker enters a specific rectangular area of the picture. The x or y coordinate of the marker within that box is then used to adjust the value, as if using a slider.

Continuous values may be altered by repeatedly hitting specific icons, e.g. one to increase and another to decrease. The icons may be replaced or supplemented with auditory cues. The left-right panning of the sounds representing the menu items guides the user when deciding where to execute the drumming gesture to choose a specific item.

The combination of the apparatus, drumming gesture and menu navigation can be generalised to provide a human computer interface in any suitable setting, beyond the specific application as a percussion instrument. During the drumming session, the computer program gives the user the option to switch the display to a sheet music rendering of what they have drummed so far, or have both the camera frames and the sheet music displayed at the same time. The sheet music is generated on the fly by the computer with each new hit, and accents are taken into account.

Sheet music generation can be stopped, resumed or started anew, and the results saved, printed or replayed.

The user can also edit the sheet music, in particular by click-and-dragging notes, which results in a real time update of the sheet music layout. The format used to save the sheet music can be loaded, displayed and played back. In this mode, a cursor indicates the current time location on the sheet music. If the user is playing along, their music is rendered on the fly under the current sheet music line. By removing the need for physical surfaces while not compromising musical expressiveness, the present disclosure opens the way for a new way of drumming, akin to dancing, in which the user is not constrained in the way they can move.

This can be implemented if the camera, optional lamp and marker size are such that they allow coverage of a large drumming volume. To address occlusion issues arising when aiming at allowing more freedom of movement, a full 3D motion capture apparatus comprising multiple cameras may be used as a replacement for the part of the disclosure concerned with the recovery of marker position and size.

The description above provides some examples of the disclosure, and it is contemplated that the features of these examples may be combined with the embodiments specified in the appended claims.

The invention claimed is:

1. A musical instrument comprising an imager arranged to provide a series of two dimensional images of an operator of the musical instrument;

a processor, coupled to the imager to receive the images, the processor configured to:

store an indication of a size and/or position of a first marker in a first selected image of the series of two dimensional images;

store an indication of a size and/or position of a second marker in the first selected image of the series of two dimensional images;

use the stored indication of the size and/or position of the first marker and the stored indication of the size and/or position of the second marker in the first selected image of the series of two dimensional images to distinguish between the first marker and the second marker in a second selected image of the series of two dimensional images independent of the proximity of the first marker relative to the second marker based on at least:

the size and/or position of the first marker and the size and/or position of the second marker in the second selected image of the series of two dimensional images, and the size and/or position of the first marker and the size and/or position of the second marker in at least one preceding image of the series of two dimensional images that was captured before the first selected image of the series of two dimensional images and the second selected image of the series of two dimensional images; and trigger an audio output signal based on at least one of:

the size and/or position of the first marker, the size and/or position of the second marker, movements of the first marker, and movements of the second marker.

2. The musical instrument of claim 1 wherein the processor is configured to respond to at least one of the first marker and the second marker completing a selected sequence of movements by selecting an audio signal for output based on at least one of the size and/or position of the first marker and the size and/or position of the second marker.

3. The musical instrument of claim 1 in which the processor is configured to:

determine, for each of the first marker and the second marker that was present in a first one of the at least one preceding image of the series of two dimensional images, whether that marker was also present in a second one of the at least one preceding image of the series of two dimensional images, if present, determine a change in size and/or a change in position of the marker between the first preceding image of the series of two dimensional images and the second preceding image of the series of two dimensional images, and distinguish between the first marker and the second marker based on at least one of the determined changes in size and/or position of the first marker and the determined changes in size and/or position of the second marker between the first preceding image of the series of two dimensional images and the second preceding image of the series of two dimensional images independent of the proximity of the first marker relative to the second marker.

4. The musical instrument of claim 2 in which the selected sequence of movements comprises at least one reversal in the movement of at least one of the first and second marker, in which a reversal comprises the at least one of the first marker and the second marker moving in a first direction at a speed superior to a selected speed for at least a selected first number of images of the series of two dimensional images, followed by a movement in a second direction opposite to the first direction, or by an absence of movement, for at least a selected second number of images of the series of two dimensional images.

5. The musical instrument of claim 2 in which the processor is configured to control a volume of the audio signal based on a speed of at least one of the first marker and the second marker.

6. The musical instrument of claim 1 in which the imager comprises only a single camera and the images consist solely of a series of two dimensional images collected from that single camera.

7. The musical instrument of claim 1 in which the first marker and the second marker each comprises a retro-reflector carried by the operator and in which the instrument further comprises a lamp positioned in proximity to the imager so as to illuminate the imager by reflecting light from the retro-reflectors when, in use, the retro-reflectors are arranged to direct light towards the imager.

8. The musical instrument of claim 2, in which the processor is configured to communicate an indication of an audio signal to a user, and to store an association between the audio signal and at least one of the size and/or position of the first and and/or position of the second marker in response to at least one of the first marker and the second marker completing a selected sequence of movements.

9. The musical instrument of claim 8 in which the indication of an audio signal comprises a name and/or another visual indication of a musical instrument.

10. The musical instrument of claim 9 in which selecting an audio signal for output comprises selecting the audio signal based on the stored association.

11. A computer implemented method of processing images to control audio signals so as to simulate a musical instrument, the method comprising:

receiving a series of two dimensional images of an operator of the musical instrument;

storing an indication of a size and/or position of a first marker in a first selected image of the series of two dimensional images;

storing an indication of a size and/or position of a second marker in the first selected image of the series of two dimensional images;

using the stored indication of the size and/or position of the first marker and the stored indication of the size and/or position of the second marker in the first selected image of the series of two dimensional images to distinguish between the first marker and the second marker in a second selected image of the series of two dimensional images independent of the proximity of the first marker relative to the second marker based on at least:

the size and/or position of the first marker and the size and/or position of the second marker in the second selected image, and the size and/or position of the first marker and the size and/or position of the second marker in at least one preceding image of the series of two dimensional images that was captured before the first selected image of the series of two dimensional images and the second selected image of the series of two dimensional images; and triggering an audio output signal based on at least one of:

the size and/or position of the first marker, the size and/or position of the second marker, movements of the first marker, and movements of the second marker.

12. The computer implemented method of claim 11 further comprising:

storing an indication of at least one of the size and/or position of the first marker and the size and/or position of the second marker in the at least one preceding image of the series of two dimensional images, for use in distinguishing between the first marker and the second marker in at least one of the first selected image and second selected image of the series of two dimensional images or a subsequent image of the series of two dimensional images.

13. The computer implemented method of claim 12 further comprising:

determining, for each of the first marker and the second marker that was present in a first one of the at least one preceding image of the series of two dimensional images, whether that marker was also present in a second one of the at least one preceding image of the series of two dimensional images;

if present, determining a change in size and/or a change in position of the marker between the first preceding image of the series of two dimensional images and the second preceding image of the series of two dimensional images, and distinguishing between the first marker and the second marker based on at least one of the determined changes in size and/or position of the first marker and the determined changes in size and/or position of the second marker between the first preceding image of the series of two dimensional images and the second preceding image of the series of two dimensional images independent of the proximity of the first marker relative to the second marker.

14. The computer implemented method of claim 11 in which the selected sequence of movements comprises at least one reversal in the movement of a marker at least one of the first marker and the second marker, in which a reversal comprises the at least one of the first marker and the second marker moving in a first direction at a speed superior to a selected speed for at least a selected first number of images of the series of two dimensional images, followed by a movement in a second direction opposite to the first direction, or by an absence of movement, for at least a selected second number of images of the series of two dimensional images.

15. The computer implemented method of claim 11 in which a volume of the triggered audio output signal is determined based on a speed of at least one of the first marker and the second marker.

16. The computer implemented method of claim 11 in which the series of two dimensional images comprises images collected solely from a single camera.

17. A computer program product, comprising a computer readable medium storing program instructions for causing a processor to perform the method of claim 11.

18. A kit for adapting a computer to provide a musical instrument, the kit comprising:

a wide angle lens adapter for a digital camera;

at least one retro-reflector to be carried by a user; and a lamp, coupled to the wide angle lens adapter so as to illuminate the wide angle lens adapter by reflecting light from the retro-reflector when, in use, the retro-reflector is arranged to direct light towards the wide angle lens adapter;

a computer program product storing program instructions for causing a processor to perform a method that comprises:

receiving a series of two dimensional images of an operator of the musical instrument;

storing an indication of a size and/or position of a first marker in a first selected image of the series of two dimensional images;

storing an indication of a size and/or position of a second marker in the first selected image of the series of two dimensional images;

using the stored indication of the size and/or position of the first marker and the stored indication of the second marker in the first selected image of the series of two dimensional images to distinguish between the first marker and the second marker in a second selected image of the series of two dimensional images independent of the proximity of the first marker relative to the second marker based on at least:

the size and/or position of the first marker and the size and/or position of the second marker in the second selected image of the series of two dimensional images, and the size and/or position of the first marker and the size and/or position of the second marker in at least one preceding image of the series of two dimensional images that was captured before the first selected image of the series of two dimensional images and the second selected image of the series of two dimensional images; and triggering an audio output signal based on at least one of:

the size and/or position of the first marker, the size and/or position of the second marker, movements of the first marker, and movements of the second marker.

19. The musical instrument of claim 1 in which the processor is further configured to:

store an indication of a size and/or position of a third marker in the first selected image of the series of two dimensional images, and use the stored indication of the size and/or position of the first marker, the stored indication of the size and/or position of the second marker, and the stored indication of the third marker in the first selected image of the series of two dimensional images to distinguish between each of the first marker, the second marker and the third marker in the second selected image of the series of two dimensional images independent of the proximity of the first marker relative to the second marker and the third marker based on at least:

the size and/or position of the first marker, the size and/or position of the second marker, and the size and/or position of the third marker in the first selected image of the series of two dimensional images, and the size and/or position of the first marker, the size and/or position of the second marker, and the size and/or position of the third marker in the second selected image of the series of two dimensional images; and trigger an audio output signal based on at least one of:

the size and/or position of the first marker, the size and/or position of the second marker, the size and/or position of the third marker, movements of the first marker, movements of the second marker, and movements of the third marker.

20. The computer implemented method of claim 11 further comprising:

identifying a third marker by determining a size and/or position of the third marker in the first selected image of the series of two dimensional images;

storing an indication of the size and/or position of the third marker in the first selected image of the series of two dimensional images;

using the stored indication of the size and/or position of the first marker, the stored indication of the size and/or position of the second marker, and size and/or position of the third marker in the first selected image of the series of two dimensional images to distinguish between each of the first marker, the second marker and the third marker independent of the proximity of the first marker relative to the second marker and the third marker in a second selected image of the series of two dimensional images based on at least:

the size and/or position of the first marker, the size and/or position of the second marker and the size and/or position of the third marker in the first selected image of the series of two dimensional images, and the size and/or position of the first marker, the size and/or position of the second marker and the size and/or position of the third marker in the second selected image of the series of two dimensional images; and triggering an audio output signal based on at least one of:

the size and/or position of the first marker, the size and/or position of the second marker, the size and/or position of the third marker, movements of the first marker, movements of the second marker, and movements of the third marker.

* * * * *